US006725688B2

(12) United States Patent
Elion et al.

(10) Patent No.: US 6,725,688 B2
(45) Date of Patent: Apr. 27, 2004

(54) CONTROLLING THE PRODUCTION OF A LIQUEFIED NATURAL GAS PRODUCT STREAM

(75) Inventors: Wiveka Jacoba Elion, The Hague (NL); Keith Anthony Jones, Amsterdam (NL); Gregory John McLachlan, The Hague (NL); Jonathan Hamilton Wilson, The Hague (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/258,636

(22) PCT Filed: Apr. 24, 2001

(86) PCT No.: PCT/EP01/04661

§ 371 (c)(1),
(2), (4) Date: Oct. 24, 2002

(87) PCT Pub. No.: WO01/81845

PCT Pub. Date: Nov. 1, 2001

(65) Prior Publication Data

US 2003/0046953 A1 Mar. 13, 2003

(30) Foreign Application Priority Data

Apr. 25, 2000 (EP) ..... 00201470

(51) Int. Cl.[7] ..... F25J 1/00; F25J 3/00
(52) U.S. Cl. ..... 62/612; 62/657
(58) Field of Search ..... 62/612, 611, 657

(56) References Cited

U.S. PATENT DOCUMENTS 3,929,438 A 12/1975 Harper et al.
4,809,154 A * 2/1989 Newton ..... 700/28
4,901,533 A * 2/1990 Fan et al. ..... 62/614
5,746,066 A * 5/1998 Manley ..... 62/612
5,791,160 A * 8/1998 Mandler et al. ..... 62/611

FOREIGN PATENT DOCUMENTS

EP 0 529 307 A1 3/1993 ..... F25J/1/02
EP 893655 A2 * 1/1999
EP 0 893 665 A2 1/1999 ..... F25J/1/02

* cited by examiner

*Primary Examiner*—William C. Doerrler

(57) ABSTRACT

Controlling the production of a liquefied natural gas consist of measuring the temperature and the flow rate of the liquefied natural gas; maintaining the flow rate of the heavy mixed refrigerant at an operator manipulated set point, and determining the flow rate of the light mixed refrigerant from the flow rate of the heavy mixed refrigerant and an operator manipulated set point for the ratio of the flow rate of the heavy mixed refrigerant to the flow rate of the light mixed refrigerant; determining a dependent set point for the ratio of the flow rate of the liquefied natural gas to the flow rate of the heavy mixed refrigerant such that the temperature of the liquefied natural gas is maintained at an operator manipulated set point; determining a dependent set point for the flow rate of the liquefied natural gas from the dependent set point for the ratio of the flow rate of the liquefied natural gas product stream to the flow rate of the heavy mixed refrigerant and the flow rate of the heavy mixed refrigerant; and maintaining the flow rate of the liquefied natural gas at its dependent set point.

14 Claims, 2 Drawing Sheets

CONTROLLING THE PRODUCTION OF A LIQUEFIED NATURAL GAS PRODUCT STREAM

FIELD OF THE INVENTION

The present invention relates to controlling the production of a liquefied natural gas product stream obtained by removing heat from natural gas in a heat exchanger, wherein the natural gas passes through one set of tubes located in the shell side of the heat exchanger. In the heat exchanger, the natural gas is in indirect heat exchange with expanded heavy mixed refrigerant and expanded light mixed refrigerant. The heavy mixed refrigerant and the light mixed refrigerant circulate in a closed refrigeration cycle, which includes the shell side of the heat exchanger, a compressor, a cooler, a separator, two additional sets of tubes in the heat exchanger and two expansion devices debouching into the shell side, wherein the heavy mixed refrigerant and the light mixed refrigerants are produced as the liquid product and the vapour product from the separator, respectively. In the shell side of the heat exchanger, the expanded heavy mixed refrigerant and the expanded light mixed refrigerants are allowed to evaporate so as to remove heat from the natural gas passing through the one set of tubes and from the heavy and light mixed refrigerant passing through the two additional sets of tubes in the heat exchanger.

BACKGROUND OF THE INVENTION

The heat exchanger can be a spoolwound heat exchanger or a plate fin heat exchanger. In the specification and in the claims the term shell side is used to refer to the cold side of the heat exchanger and the terms tube and tube bundle are used to refer to the warm side of the heat exchanger.

European patent application publication No. 893 665 discloses in FIGS. 4 and 5 a method of controlling the production of a liquefied natural gas product stream, which method comprises the steps of:

a) measuring the flow rate and the temperature of the liquefied natural gas, and measuring the flow rates of the heavy mixed refrigerant and of the light mixed refrigerant;

b) maintaining the flow rate of the liquefied natural gas product stream at an operator manipulated set point and maintaining the temperature of the liquefied natural gas product stream at an operator manipulated set point, wherein maintaining the temperature of the liquefied natural gas product stream at its operator manipulated set point comprises the steps of:

b1) determining a dependent set point for the total mixed refrigerant flow rate, the dependent set point being the sum of (i) an incremental change of the flow rate of the total mixed refrigerant to offset a difference between the temperature of the liquefied natural gas product stream and the operator manipulated set point for the temperature and (ii) the product of the operator manipulated set point for the flow rate of the liquefied natural gas product stream and the ratio of the flow rate of the total mixed refrigerant to the flow rate of the liquefied natural gas product stream (which ratio has a given value);

b2) determining a dependent set point for the light mixed refrigerant flow rate that is equal to the dependent set point for the flow rate of the total mixed refrigerant divided by the sum of 1 (=unity) and the operator manipulated set point for the ratio of the flow rate of the light mixed refrigerant to the flow rate of the heavy mixed refrigerant, and determining a dependent set point for the heavy mixed refrigerant that is the difference between the dependent set point for the flow rate of the total mixed refrigerant and the dependent set point for the light mixed refrigerant flow rate; and b3) maintaining the light mixed refrigerant flow rate and the heavy mixed refrigerant flow rate at their dependent set points.

In this method the flow rate of the liquefied natural gas product stream and its temperature are independently controlled, and the flow rate of the total mixed refrigerant is a dependent variable. As a consequence, the maximum available power from the turbines that drive the compressors cannot be fully utilized.

SUMMARY OF THE INVENTION

It is therefore an object of the present invention to provide a method of controlling the production of a liquefied natural gas product stream wherein the temperature of the liquefied natural gas product stream and the flow rate of the mixed refrigerant are controlled, such that the flow rate of the liquefied natural gas product stream is a dependent variable.

BRIEF DESCRIPTION OF DRAWINGS

The invention will now be described by way of example in more detail with reference to the accompanying drawings. The examples should not be construed to limit the scope of the invention.

DETAILED DESCRIPTION OF THE INVENTION

To this end the method of controlling the production of a liquefied natural gas product stream obtained by removing heat from natural gas in a heat exchanger in which the natural gas is in indirect heat exchange with expanded heavy mixed refrigerant and expanded light mixed refrigerant according to the present invention comprises the steps of:

a) measuring the temperature and the flow rate of the liquefied natural gas product stream and measuring the flow rates of the heavy mixed refrigerant and of the light mixed refrigerant;

b) selecting the flow rate of one of the refrigerants (the heavy mixed refrigerant, the light mixed refrigerant or the total mixed refrigerant) to have an operator manipulated set point, and generating a first output signal for adjusting the flow rate of the heavy mixed refrigerant and a second output signal for adjusting, the flow rate of the light mixed refrigerant using (i) the operator manipulated set point for the flow rate of the one of the refrigerants, (ii) the flow rates of the heavy and light mixed refrigerants and (iii) an operator manipulated set point for the ratio of the flow rate of the heavy mixed refrigerant to the flow rate of the light mixed refrigerant;

c) adjusting the flow rates of the heavy mixed refrigerant and the light mixed refrigerant in accordance with the first and second output signals;

d) determining a dependent set point for the ratio of the flow rate of the liquefied natural gas product stream to the flow rate of one of the refrigerants such that the temperature of the liquefied natural gas product stream is maintained at an operator manipulated set point, and determining a dependent set point for the flow rate of the liquefied natural gas product stream using (i) the dependent set point for the ratio of the flow rate of the liquefied natural gas product stream to the flow rate of the one of the refrigerants and (ii) the flow rate of the one of the refrigerants; and e) maintaining the flow rate of the liquefied natural gas product stream at its dependent set point.

The method of the present invention permits continuous maximum utilization of the available power to drive the compressors in the refrigeration cycle, because the operator can manipulate the set point of the flow rate of one of the refrigerants and the ratio of the flow rates of the heavy mixed refrigerant to the light mixed refrigerant.

Figure 1:
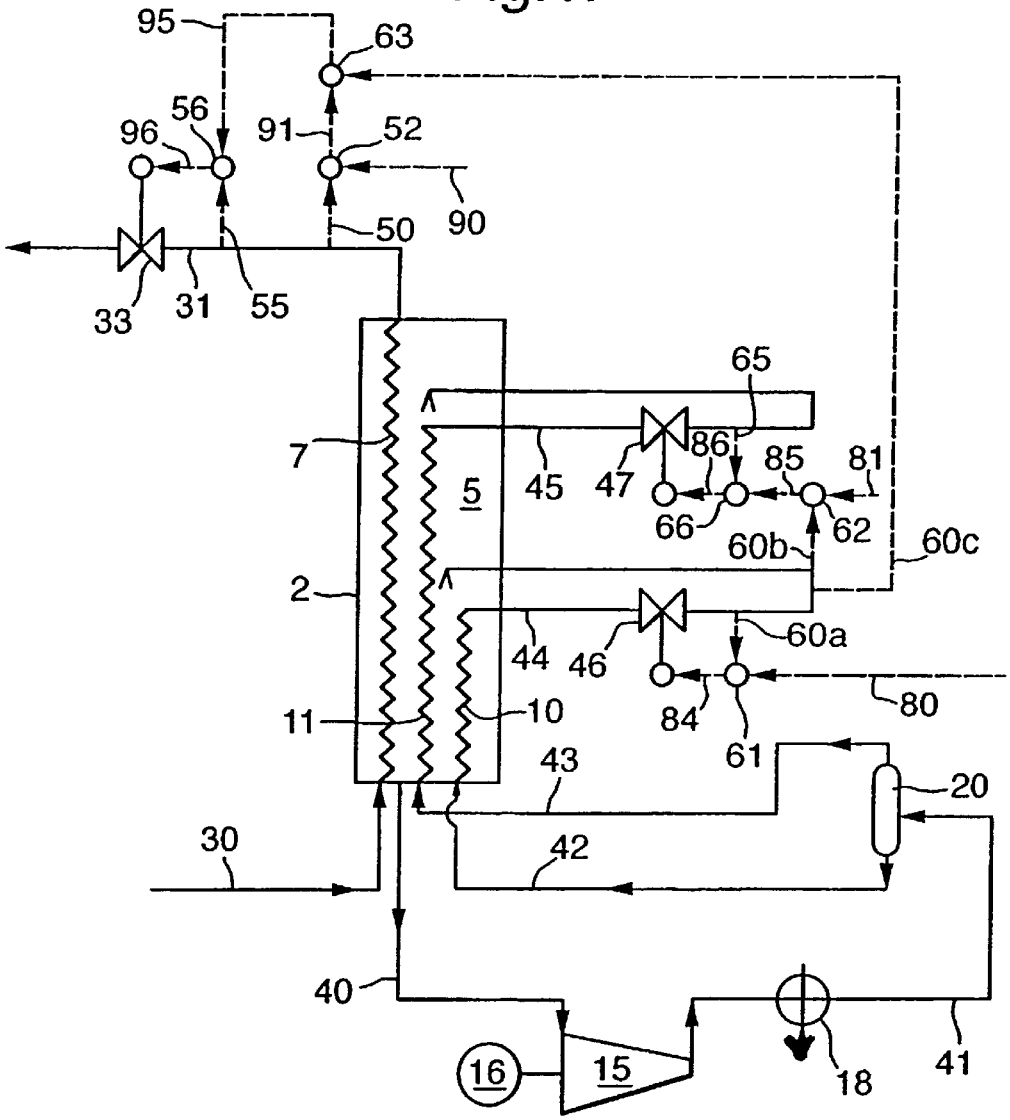
FIG. 1 shows schematically a flow scheme of a liquefaction plant provided with means for carrying out the present invention.

Reference is now made to FIG. 1. The plant for liquefying natural gas comprises a heat exchanger 2 having a shell side 5. In the shell side are arranged three tube bundles 7, 10 and 11. The plant further comprises a compressor 15 driven by a suitable driver 16, a refrigerant cooler 18 and a separator 20.

During normal operation, natural gas is supplied at liquefaction pressure through conduit 30 to the first tube bundle 7 in the heat exchanger 2. The natural gas flowing through the first tube bundle 7 is cooled, liquefied and sub-cooled. The sub-cooled liquefied natural gas flows out of the heat exchanger 2 through conduit 31. The conduit 31 is provided with an expansion device in the form of a flow control valve 33 (optionally preceded by an expansion turbine, not shown) to control the flow rate of the liquefied natural gas product stream and to allow storing of the liquefied natural gas product stream at about atmospheric pressure.

Mixed refrigerant used to remove heat from the natural gas in the heat exchanger 2 circulates through a closed refrigeration cycle. The closed refrigeration cycle includes the shell side 5 of the heat exchanger 2, conduit 40, the compressor 15, conduit 41, the cooler 18 arranged in the conduit 41, the separator 20, conduits 42 and 43, the two tube bundles 10, 11 in the heat exchanger 2, and conduits 44 and 45 debauching into the shell side 5. The conduits 44 and 45 are provided with expansion devices in the form of flow control valves 46 and 47. The flow control valves 46 and 47 can optionally be preceded by an expansion turbine, not shown.

The gaseous refrigerant, which flows from the shell side 5 of the heat exchanger 2 is compressed by the compressor 15 to a high pressure. In the cooler 18 the heat of compression is removed and the mixed refrigerant is partially condensed. Cooling and partial condensation of the mixed refrigerant may also be done in more than one heat exchanger. In the separator 20, the mixed refrigerant is separated into heavy mixed refrigerant and light mixed refrigerant, which are the liquid product and the vapour product, respectively.

Heavy mixed refrigerant is passed through the conduit 42 to the second tube bundle 10, in which it is sub-cooled. Light mixed refrigerant is passed through conduit 43 to the third tube bundle 11, in which it is liquefied and sub-cooled.

Sub-cooled heavy mixed refrigerant and light mixed refrigerant are passed via the flow control valves 46 and 47 into the shell side 5, where they are allowed to evaporate at a low pressure so as to remove heat from the natural gas in the first tube bundle 7 and from the refrigerants passing through the additional tube bundles 10 and 11.

According to the present invention the production of the liquefied natural gas product stream is controlled in the following way.

First of all the temperature and the flow rate of the liquefied natural gas product stream flowing through the conduit 31 are measured. The temperature measurement signal, referred to with reference numeral 50, is passed to a temperature controller 52. The flow rate measurement signal, referred to with reference numeral 55 is passed to a first flow rate controller 56.

In addition, the flow rates of the heavy mixed refrigerant and of the light mixed refrigerant passing through conduits 44 and 45, respectively are measured. The heavy mixed refrigerant flow rate measurement signals, referred to with reference numerals 60*a*, 60*b* and 60*c*, are passed to a second flow rate controller 61, to a first flow ratio controller 62 and to a second flow ratio controller 63, respectively. The light mixed refrigerant flow rate measurement signal, referred to with reference numeral 65 is passed to a third flow rate controller 66.

The next step comprises controlling the flow rates of the refrigerants. At first, the flow rate of one of the refrigerants (the heavy mixed refrigerant, the light mixed refrigerant or the total mixed refrigerant) is selected to have an operator manipulated set point. In the embodiment of FIG. 1 the heavy mixed refrigerant is selected to have an operator manipulated set point, which is a set point signal referred to with reference numeral 80 that is supplied to the second flow rate controller 61.

The flow rate of the heavy mixed refrigerant is controlled using (i) the operator manipulated set point 80 for the flow rate of the heavy mixed refrigerant and (ii) the measured flow rate 60*a* of the heavy mixed refrigerant.

A difference between the measured flow rate 60*a* of the heavy mixed refrigerant and its operator manipulated set point 80 causes the second flow rate controller 61 to generate an output signal 84 that adjusts the position of the flow control valve 46. The adjustment is such that the absolute value of the difference is below a predetermined norm. The flow rate of the light mixed refrigerant is controlled using (i) the measured flow rates 60*b* and 65 of the heavy and the light mixed refrigerant and (ii) an operator manipulated set point 81 for the ratio of the flow rate of the heavy mixed refrigerant to the flow rate of the light mixed refrigerant.

The first flow ratio controller 62 divides the measured flow rate 60*b* of the heavy mixed refrigerant by the operator manipulated set point 81 for the ratio of the flow rates of heavy mixed refrigerant and light mixed refrigerant to generate an output signal 85 that is the dependent set point for the third flow rate controller 66. Then a difference between the measured flow rate 65 of the light mixed refrigerant and its dependent set point 85 causes the third flow rate controller 66 to generate a second output signal 86 that adjusts the position of the flow control valve 47. The adjustment is such that the absolute value of the difference is below a predetermined norm. In an alternative embodiment (not shown) a difference between the ratio of the measured flow rate 60*b* of the heavy mixed refrigerant to the measured flow rate 65 of the light mixed refrigerant and the operator manipulated set point 81 for this ratio, causes the first flow ratio controller 62 to generate an output signal 85 that is the dependent set point for the third flow rate controller 66. Then a difference between the measured flow rate 65 of the light mixed refrigerant and its dependent set point 85 causes the third flow rate controller 66 to generate a second output signal 86 that adjusts the position of the flow control valve 47. The adjustment is such that the absolute value of the difference is below a predetermined norm.

In this way the flow rates of the heavy mixed refrigerant and the light mixed refrigerants are controlled. Secondly the temperature of the liquefied natural gas product stream is controlled. To this end, a dependent set point for the ratio of the flow rate of the liquefied natural gas product stream to the flow rate of one of the refrigerants (in this case the heavy mixed refrigerant) is determined such that the temperature of the liquefied natural gas product steam is maintained at an operator manipulated set point. The operator manipulated set point for the temperature of the liquefied natural gas product stream is a set point signal referred to with reference numeral 90 that is supplied to the temperature controller 52.

A difference between the temperature 50 of the liquefied natural gas product stream and its operator manipulated set point 90 causes the temperature controller 52 to generate an output signal that is the dependent set point 91 for the second flow ratio controller 63. Using the measured flow rate 60*c* of the heavy mixed refrigerant the second flow ratio controller 63 generates an output signal 95 that is the dependent set point for the flow rate of the liquefied natural gas product stream. A difference between the measured flow rate 55 of the liquefied natural gas product stream and its dependent set point 95 causes the first flow rate controller 56 to generate an output signal 96 that adjusts the position of the flow control valve 33. The adjustment is such that the absolute value of the difference is below a predetermined norm.

In this way the flow rate of the liquefied natural gas product stream is controlled in such a way that the temperature of the liquefied natural gas product stream is maintained at its operator manipulated set point.

An advantage of this control method is that the flow rate of the liquefied natural gas product stream is adjusted to maintain the temperature of the product stream at its operator manipulated set point in the form of trim control. Moreover, because the operator can manipulate the set point 80 for the heavy mixed refrigerant flow rate and the set point 81 for the ratio, the available power of the driver 16 can be fully utilized.

It may be necessary to override the above-described temperature control. If that is the case, the above way of controlling the flow rate of the liquefied natural gas product stream is overridden by determining a dependent set point for the flow rate of the liquefied natural gas product stream such that the temperature of the liquefied natural gas is maintained at an operator manipulated set point. In this case, the temperature controller 52 works directly on the first flow rate controller 56.

There are two alternatives for controlling the flow rates of the refrigerants. In the first alternative, the flow rate of the light mixed refrigerant is selected to have an operator manipulated set point. The method then comprises generating a second output signal for adjusting the flow rate of the light mixed refrigerant using the operator manipulated set point for the flow rate of the light mixed refrigerant, and generating a first output signal for adjusting the flow rate of the heavy mixed refrigerant using (i) the measured flow rates of the heavy mixed refrigerant and of the light mixed refrigerant and (ii) an operator manipulated set point for the ratio of the flow rate of the heavy mixed refrigerant to the flow rate of the light mixed refrigerant.

In the second alternative the flow rate of the total mixed refrigerant is selected to have an operator manipulated set point. The method then comprises generating a first output signal for adjusting the flow rate of the heavy mixed refrigerant and a second output signal for adjusting the flow rate of the light mixed refrigerant using (i) the operator manipulated set point for the flow rate of the total mixed refrigerant, (ii) the measured flow rates of the heavy and light mixed refrigerants and (iii) an operator manipulated set point for the ratio of the flow rate of the heavy mixed refrigerant to the flow rate of the light mixed refrigerant.

There are several alternatives for controlling the temperature of the liquefied natural gas product stream. In the first alternative, a dependent set point for the ratio of the flow rate of the liquefied natural gas product stream to the flow rate of the light mixed refrigerant is determined such that the temperature of the liquefied natural gas product stream is maintained at the operator manipulated set point. The method then comprises determining a dependent set point for the flow rate of the liquefied natural gas product stream using (i) the dependent set point for the ratio of the flow rate of the liquefied natural gas product stream to the flow rate of the light mixed refrigerant and (ii) the measured flow rate of the light mixed refrigerant.

In the second alternative a dependent set point for the ratio of the flow rate of the liquefied natural gas product stream to the flow rate of the total mixed refrigerant is determined such that the temperature of the liquefied natural gas product stream is maintained at the operator manipulated set point. The method then comprises determining a dependent set point for the flow rate of the liquefied natural gas product stream using (i) the dependent set point for the ratio of the flow rate of the liquefied natural gas product stream to the flow rate of the total mixed refrigerant and (ii) the measured flow rate of the total mixed refrigerant.

Figure 2:
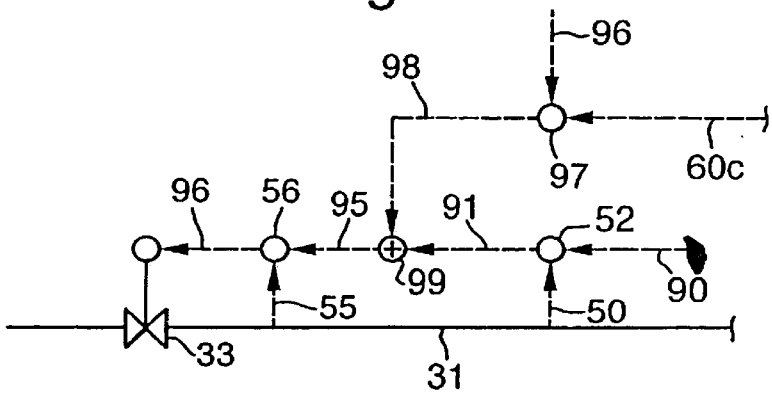
FIG. 2 shows schematically an alternative control for the liquefied natural gas product stream.

Reference is made to FIG. 2, which shows a further alternative. Parts shown in FIG. 2 that are identical to parts shown in FIG. 1 are given the same reference numerals. In this alternative embodiment, the ratio of the flow rate of the liquefied natural gas product stream to the flow rate of the heavy mixed refrigerant is not determined so as to control the temperature, but it is an operator manipulated set point 96, which is a set point signal supplied to a third ratio controller 97. The third ratio controller 97 generates a first output signal 98 using (i) the operator manipulated set point 96 for the ratio of the flow rate of the liquefied natural gas product stream to the flow rate of the heavy mixed refrigerant and (ii) the measured flow rate 60*c* of the heavy mixed refrigerant. The temperature controller 52 generates a second output signal 91 using the operator manipulated set point 90 for the temperature and the measured temperature 50. The output signals are each multiplied with a separate weighting factor and the weighted signals are then added in adder 99 to obtain the dependent set point 95 for the flow rate of the liquefied natural gas product stream.

Alternatively, the flow rate of the light mixed refrigerant is used or the flow rate of the total mixed refrigerant.

Using both the ratio and the temperature to control the flow rate of the liquefied natural gas product stream is particularly suitable, when the flow rate measurement is not too accurate. When the flow rate measurement signal is not accurate, the weighting factor applied to the first output signal 98 can have a low value.

Suitably, the liquefaction plant is provided with means (not shown) to measure the power delivered by the driver 16, which means can override the operator manipulated set point 80 for the flow rate of the heavy mixed refrigerant if the power delivered by the driver 16 has reached a predetermined maximum value. The override ensures that the operator manipulated set point 80 for the flow rate of the heavy mixed refrigerant can no longer be increased. Alternatively, when either the light mixed refrigerant or the total mixed refrigerant has an operator manipulated set point, the means can override one of the latter set points.

Suitably, the driver 16 is a gas turbine, and the temperature of the gas at the exhaust of the gas turbine is used as a measure of the power of the driver.

In the embodiment shown in FIG. 1, the first flow ratio controller 62 controls the dependent set point 85 of the third flow rate controller 66 using the measured flow rate of the heavy mixed refrigerant and the operator manipulated set point 80 for the ratio between the flow rate of the heavy mixed refrigerant to the flow rate of the light mixed refrigerant. Alternatively, this ratio can be the ratio of the ratio of the flow rate of the heavy mixed refrigerant to the flow rate of the total mixed refrigerant or the ratio of the flow rate of the light mixed refrigerant to the flow rate of the total mixed refrigerant.

Figure 3:
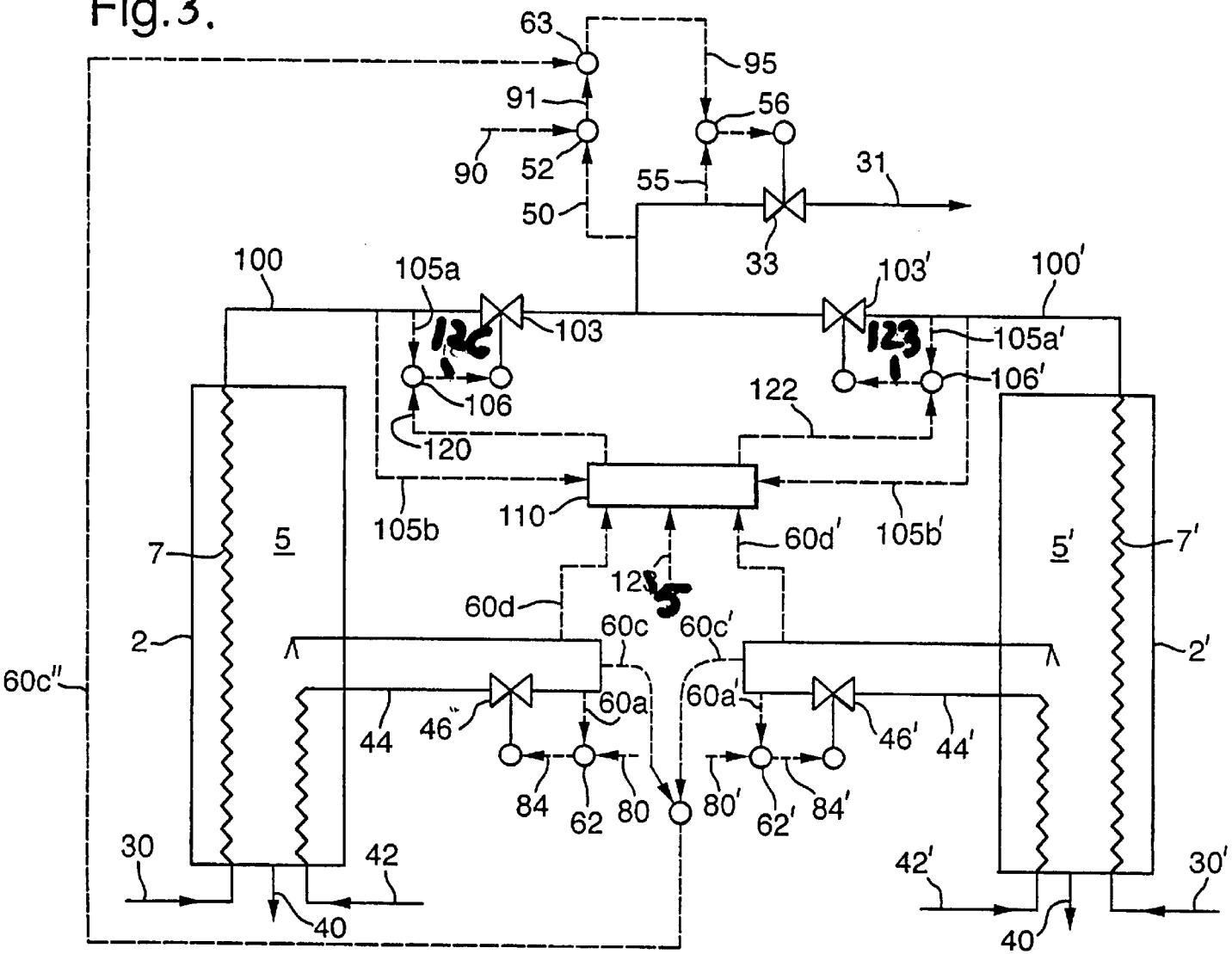
FIG. 3 shows schematically an alternative embodiment of the invention.

Reference is now made to FIG. 3, which shows schematically an alternative embodiment of the present invention, wherein the liquefied natural gas product stream is obtained by adding the liquefied natural gas leaving two identical heat exchangers arranged in a parallel line-up. Parts shown in FIG. 3 that are identical to parts shown in FIG. 1 are given the same reference numerals, and, for the sake of clarity, we have omitted from FIG. 2 the compressor, the separator and the light mixed refrigerant flow path.

The plant now comprises two substantially identical heat exchangers, 2 and 2'. In the heat exchangers 2 and 2' the natural gas passes through the first tube bundles 7 and 7', where it is in indirect heat exchange with expanded heavy mixed refrigerant and expanded light mixed refrigerant. Natural gas leaves the first heat exchanger 2 through conduit 100, and it leaves the second heat exchanger through conduit 100'. The two liquefied gas streams are combined to obtain the liquefied natural gas product stream that flows through conduit 31.

The flow rates of the heavy and light mixed refrigerants for each of the heat exchangers 2 and 2' are controlled in the way already discussed with reference to FIG. 1. The temperature and the flow rate of the liquefied natural gas product stream are controlled by the method as described in the above with reference to FIGS. 1 and 2.

Controlling the temperature and the flow rate of the liquefied natural gas product stream is now discussed in more detail. A difference between the temperature 50 of the liquefied natural gas product stream and its operator manipulated set point 90 causes the temperature controller 52 to generate a set point signal that is the dependent set point 91 for the second flow ratio controller 63. Using the measured flow rate 60*c*" of the heavy mixed refrigerant the first flow ratio controller generates a set point signal 95 that is the dependent set point for the first flow rate controller 56. A difference between the measured flow rate of the liquefied natural gas product stream 55 and its dependent set point 95 causes the first flow rate controller 56 to generate an output signal 96 that adjusts the position of the flow control valve 33. The adjustment is such that the absolute value of the difference is below a predetermined norm.

Here the flow rate of the heavy mixed refrigerant 60*c*" is the sum of the flow rates 60*c* and 60*c*'. It will be understood that in place of the flow rate of the heavy mixed refrigerant, one can use also the flow rate of the light mixed refrigerant or the flow rate of the total mixed refrigerant.

In order to balance the flow of liquefied natural gas through the conduits 100 and 100', these conduits are provided with flow control valves 103 and 103'. The flow rates in the conduits 100 and 100' are measured, and the measurement signals 105*a* and 105*a*' are supplied to flow controllers 106 and 106'. Moreover measurement signals 105*b* and 105*b*' are supplied to a further flow controller 110.

The flow control valves 103 and 103' are both put in the fully open position, and the further flow controller 110 determines which of the two measured flow rates, 105*b* or 105*b*' is the smallest. Let the flow rate 105*b* be the smallest. Then the flow control valve 103 is kept at its fully open position, and a dependent set point 122 for the flow rate of the liquefied natural gas flowing through flow control valve 103' is determined. The dependent set point 122 is so determined that that the flow rate 105*b*' is equal to the flow rate 105*b*.

A difference between the measured flow rate 105*a*' and its set point 122 generates an output signal 123 that adjusts the position of the control valve 103'. The adjustment is such that the absolute value of the difference is below a predetermined norm.

In a further embodiment, an imbalance in the flow rates of one of the refrigerant flows is also taken into account. As an example the flow rate of the heavy mixed refrigerant is taken. These flow rates 60*d* and 60*d*' are supplied to the further flow controller 110.

The flow control valves 103 and 103' are both put in the fully open position, and the further flow controller 110 determines which of the two measured flow rates, 105*b* or 105*b*' is the smallest. Let now the flow rate 105*b*' be the smallest. Then the flow control valve 103' is kept at its fully open position, and a dependent set point 120 for the flow rate of the liquefied natural gas flowing through flow control valve 103 is determined. To determine the dependent set point 120, the further flow controller 110 determines (i) the ratio of the measured flow rate 105*b* of the liquefied natural gas leaving the first heat exchanger to the measured flow rate 60*d* of the heavy mixed refrigerant supplied to the first heat exchanger 2 and (ii) the ratio of the measured flow rate 105*b*' of the liquefied natural gas leaving the second heat exchanger 2' to the measured flow rate 60*d*' of the heavy mixed refrigerant supplied to the second heat exchanger 2'. And then the quotient of the two ratios is compared with an operator manipulated set point for this quotient, which operator manipulated set point is set point signal 125 supplied to the further flow controller 110.

A difference between the measured flow rate 105*a* and its set point 120 generates an output signal 126 that adjusts the position of the control valve 103. The adjustment is such that the absolute value of the difference is below a predetermined norm.

Instead of using the ratio with the flow rate of the heavy mixed refrigerant 60*d* and 60*d*', the ratio can also be obtained using the flow rate of the light mixed refrigerant or the flow rate of the total mixed refrigerant.

In a further embodiment, the flow rates of the liquefied natural gas from the heat exchangers 2 and 2' are balanced using the temperatures of these streams. To this end a temperature controller (not shown) compares the temperature of the liquefied natural gas in conduit 100 to the temperature of the liquefied natural gas in conduit 100'. The temperature controller first determines the stream having the highest temperature, and then adjust the set point for the flow controller of that stream, so as to decrease the temperature of that liquefied natural gas stream.

In the above described embodiments of the invention, the output signals for adjusting the flow rates of the refrigerants are determined from the (i) the measured flow rates of the refrigerants and (ii) an operator manipulated set point for the ratio of the flow rate of the heavy mixed refrigerant to the flow rate of the light mixed refrigerant. However instead of using the measured flow rate of one of the other refrigerants, the operator manipulated set point for that refrigerant can be used. And the same applies to determining the dependent set point for the flow rate of the liquefied natural gas product stream.

In order to prevent large variations in the temperature of the liquefied natural gas product stream a lag can be introduced in the signal 95 that is the set point for the flow rate of the liquefied natural gas product stream.

The flow rates are mass flow rates and they are suitably measured upstream a flow control valve. Also the temperature of a flow is suitably measured upstream a flow control valve.

We claim:

1. A method of controlling the production of a liquefied natural gas product stream obtained by removing heat from natural gas in a heat exchanger in which the natural gas is in indirect heat exchange with expanded heavy mixed refrigerant and expanded light mixed refrigerant, which method comprises the steps of:

a) measuring the temperature and the flow rate of the liquefied natural gas product stream and measuring the flow rates of the heavy mixed refrigerant and of the light mixed refrigerant;

b) selecting the flow rate of one of the refrigerants (the heavy mixed refrigerant, the light mixed refrigerant or the total mixed refrigerant) to have an operator manipulated set point, and generating a first output signal for adjusting the flow rate of the heavy mixed refrigerant and a second output signal for adjusting the flow rate of the light mixed refrigerant using (i) the operator manipulated set point for the flow rate of the one of the refrigerants, (ii) the flow rates of the heavy and light mixed refrigerants and (iii) an operator manipulated set point for the ratio of the flow rate of the heavy mixed refrigerant to the flow rate of the light mixed refrigerant;

c) adjusting the flow rates of the heavy mixed refrigerant and the light mixed refrigerant in accordance with the first and second output signals;

d) determining a dependent set point for the ratio of the flow rate of the liquefied natural gas product stream to the flow rate of one of the refrigerants such that the temperature of the liquefied natural gas product stream is maintained at an operator manipulated set point, and determining a dependent set point for the flow rate of the liquefied natural gas product stream using (i) the dependent set point for the ratio of the flow rate of the liquefied natural gas product stream to the flow rate of the one of the refrigerants and (ii) the flow rate of the one of the refrigerants; and e) maintaining the flow rate of the liquefied natural gas product stream at its dependent set point.

2. The method according to claim 1, wherein controlling the flow rate of the liquefied natural gas product stream according to step d) is overridden by determining a dependent set point for the flow rate of the liquefied natural gas product stream such that the temperature of the liquefied natural gas is maintained at an operator manipulated set point.

3. The method according to claim 1, wherein step b) comprises selecting the flow rate of the heavy mixed refrigerant to have an operator manipulated set point, generating a first output signal for adjusting the flow rate of the heavy mixed refrigerant using the operator manipulated set point for the flow rate of the heavy mixed refrigerant, generating a second output signal for adjusting the flow rate of the light mixed refrigerant using (i) the flow rates of the heavy mixed refrigerant and the light mixed refrigerant and (ii) an operator manipulated set point for the ratio of the flow rate of the heavy mixed refrigerant to the flow rate of the light mixed refrigerant.

4. The method according to claim 1, wherein step b) comprises selecting the flow rate of the light mixed refrigerant to have an operator manipulated set point, generating a second output signal for adjusting the flow rate of the light mixed refrigerant using the operator manipulated set point for the flow rate of the light mixed refrigerant, and generating a first output signal for adjusting the flow rate of the heavy mixed refrigerant using (i) the flow rates of the heavy mixed refrigerant and the light mixed refrigerant and (ii) an operator manipulated set point for the ratio of the flow rate of the heavy mixed refrigerant to the flow rate of the light mixed refrigerant.

5. The method according to claim 1, wherein step b) comprises selecting the flow rate of the total mixed refrigerant to have an operator manipulated set point, and generating a first output signal for adjusting the flow rate of the heavy mixed refrigerant and a second output signal for adjusting the flow rate of the light mixed refrigerant using (i) the operator manipulated set point for the flow rate of the total mixed refrigerant, (ii) the flow rates of the heavy and light mixed refrigerants and (iii) an operator manipulated set point for the ratio of the flow rate of the heavy mixed refrigerant to the flow rate of the light mixed refrigerant.

6. The method according to claim 1, wherein the one of the refrigerants in step d) is the heavy mixed refrigerant.

7. The method according to claim 1, wherein the one of the refrigerants in step d) is the light mixed refrigerant.

8. The method according to claim 1, wherein the one of the refrigerants in step d) is the total mixed refrigerant.

9. The method according to claim 1, wherein step d) comprises generating an output signal using (i) an operator manipulated set point for the ratio of the flow rate of the liquefied natural gas product stream to the flow rate of one of the refrigerants and (ii) the flow rate of the one of the refrigerants; generating a second output signal using an operator manipulated set point for the temperature and the measured temperature; and multiplying the output signals with a weighting factor and adding the weighted signals to obtain a dependent set point for the flow rate of the liquefied natural gas product stream.

10. The method according to claim 9, wherein the one of the refrigerants is the heavy mixed refrigerant.

11. The method according to claim 9, wherein the one of the refrigerants is the light mixed refrigerant.

12. The method according to claim 9, wherein the one of the refrigerants is the total mixed refrigerant.

13. The method according to claim 1, wherein the mixed refrigerant used to remove heat from the natural gas is compressed by a compressor driven by a suitable driver, which method further comprises the steps of measuring the power delivered by the driver, and overriding the operator manipulated set point for the flow rate of one of the refrigerants of step b) if the power has reached a predetermined maximum value, in order that the operator manipulated set point for the flow rate of one of the refrigerants can no longer be increased.

14. The method according to claim 13, wherein the driver is a gas turbine, and wherein the temperature of the gas at the exhaust of the gas turbine is used as a measure of the power of the driver.

* * * * *